US008207432B2

(12) United States Patent
Fodera

(10) Patent No.: US 8,207,432 B2
(45) Date of Patent: Jun. 26, 2012

(54) ACOUSTIC AND SEMI-ACOUSTIC STRINGED INSTRUMENTS HAVING A NECK-TO-BODY JUNCTION

(75) Inventor: Vincent Fodera, Brooklyn, NY (US)

(73) Assignee: Fodera Guitars LLC, Brooklyn, NY (US)

( * ) Notice: Subject to any disclaimer, the term of this patent is extended or adjusted under 35 U.S.C. 154(b) by 0 days.

(21) Appl. No.: 12/954,082

(22) Filed: Nov. 24, 2010

(65) Prior Publication Data

US 2012/0125174 A1 May 24, 2012

(51) Int. Cl.
*G10D 1/02* (2006.01)

(52) U.S. Cl. ..... 84/267

(58) Field of Classification Search ..... 84/290, 84/293, 291

See application file for complete search history.

(56) References Cited

U.S. PATENT DOCUMENTS 6,888,054 B2 5/2005 Minakuchi
7,705,224 B1 * 4/2010 Ward ..... 84/267
7,790,970 B2 * 9/2010 McPherson ..... 84/291

* cited by examiner

*Primary Examiner* — Kimberly Lockett
(74) *Attorney, Agent, or Firm* — Lowenstein Sandler PC

(57) ABSTRACT

An instrument comprising a neck-to-body junction including a solid upper body portion to which the instrument's neck and fingerboard are attached forming a neck member. The neck member is then engaged with a hollow cavity representative of the lower body an acoustic or semi-acoustic stringed instruments. The upper body portion of the neck member extends into the hollow cavity of the lower body to create a uniform body structure. A carve-out feature is then formed in close proximity to the base of the neck and extends into the underside of the upper body portion. The carve-out comprises a smooth and continuous surface that enables a player's hand to comfortably access higher positions on the instrument's neck when the instrument is played in the normal playing position.

4 Claims, 5 Drawing Sheets

ACOUSTIC AND SEMI-ACOUSTIC STRINGED INSTRUMENTS HAVING A NECK-TO-BODY JUNCTION

FIELD OF THE INVENTION

This invention relates to acoustic and semi-acoustic stringed instruments, more particularly to instruments having a neck-to-body junction, which eliminates the need for a neck heel, and thus allows greater playability and easier access to higher positions on the fingerboard of the instrument when the instrument is played in the normal playing position.

BACKGROUND OF THE INVENTION

Instruments such as guitars, violins, cellos, banjos and mandolins produce sound by way of vibrating strings that are fixed at two end points. The strings are held under constant tension and the sound produced by each string is varied by selectively shortening or lengthening the strings by pressing the strings against a fingerboard mounted atop an elongated neck attached to the body of the instrument. The neck on a typical guitar is divided into portions called frets which represent various notes on the chromatic scale. Other stringed instruments such as violins, violas, cellos and double basses do not have frets and therefore an infinite number of tonal frequencies may be produced. A user (i.e. a player) uses the instrument to produce sounds of various frequencies by applying pressure to frets or positions on the instrument's fingerboard and causing the strings to vibrate by strumming, plucking or bowing the strings. The sound of the vibrating strings can be amplified by constructing the instrument's body from a resonating material such as wood. In addition, pick-ups can be used to convert the string vibration into electrical signals which can then be sent to a speaker for amplification.

In order to produce sound, the strings of such instruments must be stretched and kept under high tension. For example, once properly tuned, the strings of a six-string acoustic guitar can require a total tension of approximately 200 pounds. The body of the guitar and the guitar neck must therefore be strong enough to withstanding such high tension without deforming or causing separation of the neck and body. In addition to withstanding high string tensions, the neck must be joined to the body in such a way as to maintain strength, rigidity and playability of the instrument.

Various methods exist for attaching the necks of instruments such as guitars, violins, banjos and mandolins to the body of the instrument. In the case of solid-body electric guitars such as the Fender® Stratocaster, the neck is attached to the upper part of the body using screws. This method generally requires the use of four screws to mount the lower portion of the neck to the upper portion of the guitar body. While this "bolt-on" method provides a great deal of strength, the guitar's playability is hindered due to a rectangular heel formed where the neck is bolted to the body. The heel prevents a player's hand from easily accessing higher positions on the fingerboard when the guitar is played in the normal or convention playing position due to the heel's size and positioning relative to the end of the neck.

The normal playing position can vary depending on the type of acoustic or semi-acoustic stringed instrument. In the case of instruments such as guitars, bass guitars, mandolins and ukuleles, the instrument's body is generally situated near the mid-section of the player's body. The instrument can be played while the user is in the seated position or the instrument can played while the user is standing by means of a strap or similar mechanism that suspends the instrument from the user's shoulder. Depending on user preference, the angle of the neck may be varied about the horizontal axis. The player uses one hand to strum or pluck the instrument's strings while the other hand varies the string length using the fingerboard. In the case of instruments such as violins and violas, the instrument's body is generally supported between the user's shoulder and chin with the instrument's neck generally kept parallel to the horizontal axis. The player uses a bow in one hand to make the strings vibrate and uses the other hand to vary the string length on the fingerboard. In the case of instruments such as cellos and upright basses, the instrument is generally held in an upright position perpendicular to the horizontal axis. A user may play these instruments in the seated or standing position. The player then uses one hand to either pluck or bow the strings and uses the other hand to vary the string length on the fingerboard.

Many acoustic stringed instruments also utilize a "bolt-on" method to attach the neck to the body. For example, the neck of an acoustic guitar is constructed with a heel plate (or foot) that extends perpendicularly from the base of the neck. Two holes are drilled in the face of the heel plate and screws are used to affix the face of the heel plate to a block located in the upper portion of the instrument's body. In an acoustic guitar, the heel plate is generally located near the 12th fret. As in the case of a bolt-on neck in the solid-body electric guitar, the heel plate in an acoustic guitar neck prevents a player's hand from accessing frets above the 12th fret and therefore results in significant playability issues when the acoustic guitar is played in the normal position.

Some acoustic and hollow-body electric guitars and many bowed instruments (such as violins, violas and cellos) use dovetail or mortise joints to attach the neck to the body of the instrument. This configuration is very similar to the bolt-on acoustic guitar neck in that it uses a heel plate (or foot) which extends perpendicularly from the base of the neck. However, the face of the heel plate contains either a tapered dovetail joint or straight mortise joint which is glued to a corresponding joint on the upper part of the instrument's body. As in the case of a bolt-on neck, a neck affixed to the instrument body using a dovetail joint has the same playability issues because of the heel geometry. The heel prevents a player's hand from accessing higher frets on the fingerboard when the instrument is played in the normal position.

Finally, many classical and flamenco-style guitars use a flat heel plate to attach the neck to the body of the instrument. The heel plate is comprised of a flat surface that is glued directly to a flat plate on the upper body of the instrument. Classical and flamenco-style guitars still have playability issues because of the heel located at the base of the neck which prevents a player's hand from reaching frets above the 14th fret when the instrument is played in the normal position.

The playability and fret-access problems in solid body electric guitars have been overcome using a neck-through-body approach similar to that described in U.S. Pat. No. 6,888,054 issued to Minakuchi. The neck in a neck-through-body guitar has an additional portion that extends integrally from the base of the neck. The extended portion of the neck is then mounted into a rectangular engagement hollow or channel cut directly into the back of the body of the guitar. In this structure, the neck extends through the entire length of the body thus removing the need for a heel at the base of the neck. A smoothly curved surface or carve-out can be formed in the area where the base of the neck meets the upper part of the guitar body. This carve-out provides the user with greater access to upper frets on the fingerboard when the guitar is played in the normal position.

However, the neck-through-body structure common to many solid body electric guitars is not suitable for use on acoustic or semi-acoustic instruments. A primary disadvantage of using a neck-through structure in an acoustic or semi-acoustic instrument is the fact that having a solid neck extend through the entire body would greatly limit the size of the sound box created by the instrument's body. This reduction in the size of the sound box would reduce the resonating capability of the sound box to an unacceptable level. Another problem is that the neck-through structure would not solve the problem of fret access in an acoustic guitar because of the greater body thickness in acoustic instruments. While a neck-through design would potentially eliminate the heel plate of an acoustic stringed instrument, the body shape and thickness would still prevent a player's hand from accessing higher frets when playing the instrument in the normal position. Another reason a neck-through structure is not suitable for use in acoustic and semi-acoustic instruments is because the carve-out feature on many neck-through-body electric guitars could not be replicated in an acoustic or semi-acoustic instrument because of the lack of a solid upper body portion capable of accepting the carve-out Therefore, a need exists in the art for an acoustic or semi-acoustic instrument having a neck joined to the body in a manner that eliminates the traditional heel obstruction and thereby allows greater ease in accessing higher positions on the fingerboard when the instrument is played in the normal position. In addition, there is a need for a neck-to-body junction which is strong enough to withstand high string tension while maximizing the size of the instrument's sound box.

SUMMARY OF THE INVENTION

It is an object of the present invention to provide a neck-to-body junction for an acoustic or semi-acoustic stringed instrument that eliminates the need for the traditional heel obstruction at the base of the neck, provides a sufficiently strong connection between the neck and body of the instrument and allows a player to comfortably access and play higher notes on the instrument's fingerboard (i.e., the notes above approximately the 12th fret in the case of fretted instruments) while playing the instrument in the normal playing position. According to an embodiment of the present invention, the neck-to-body junction comprises a smoothly-curved portion (hereinafter referred to as a "carve-out") extending from the base portion of the neck into the underside of the upper body portion of the instrument in both the perpendicular and radial directions thereby contributing to enhanced comfort, playability and access to higher positions on the instrument's neck.

According to an embodiment of the invention, the neck-to-body junction is comprised of a substantially-solid upper body portion attached to a neck and fingerboard (the result of attaching a neck to an upper body is hereinafter referred to as the "neck member"). The neck and upper body will typically be fabricated from separate pieces and then affixed at the lower end of the neck, preferably using a commercially available adhesive suitable for stringed instruments. The upper body can be any suitable size and shape, preferably a size and shape representative of the upper body of a large number of acoustic and semi-acoustic stringed instruments. The neck member is then engaged with a sound box representative of the lower body of a large number of acoustic and semi-acoustic stringed instruments. According to an embodiment of the present invention, the upper body portion of the neck member extends into the sound box of the lower body to create a uniform body structure.

According to an embodiment of the present invention, a carve-out is formed in the neck member in close proximity to the base of the neck. The carve-out extends into the underside of the upper body portion in both the perpendicular and radial directions and forms a continuous surface that enables a player's hand to comfortably access higher positions on the instrument's neck when the instrument is played in the normal playing position. The carve-out can be any suitable size and shape taking into account the shape of the upper body and the degree of desired access to upper positions on the instrument's neck.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale, and are not intended to be limiting in terms of the range of possible shapes and/or proportions.

DETAILED DESCRIPTION OF THE INVENTION

Figure 3:
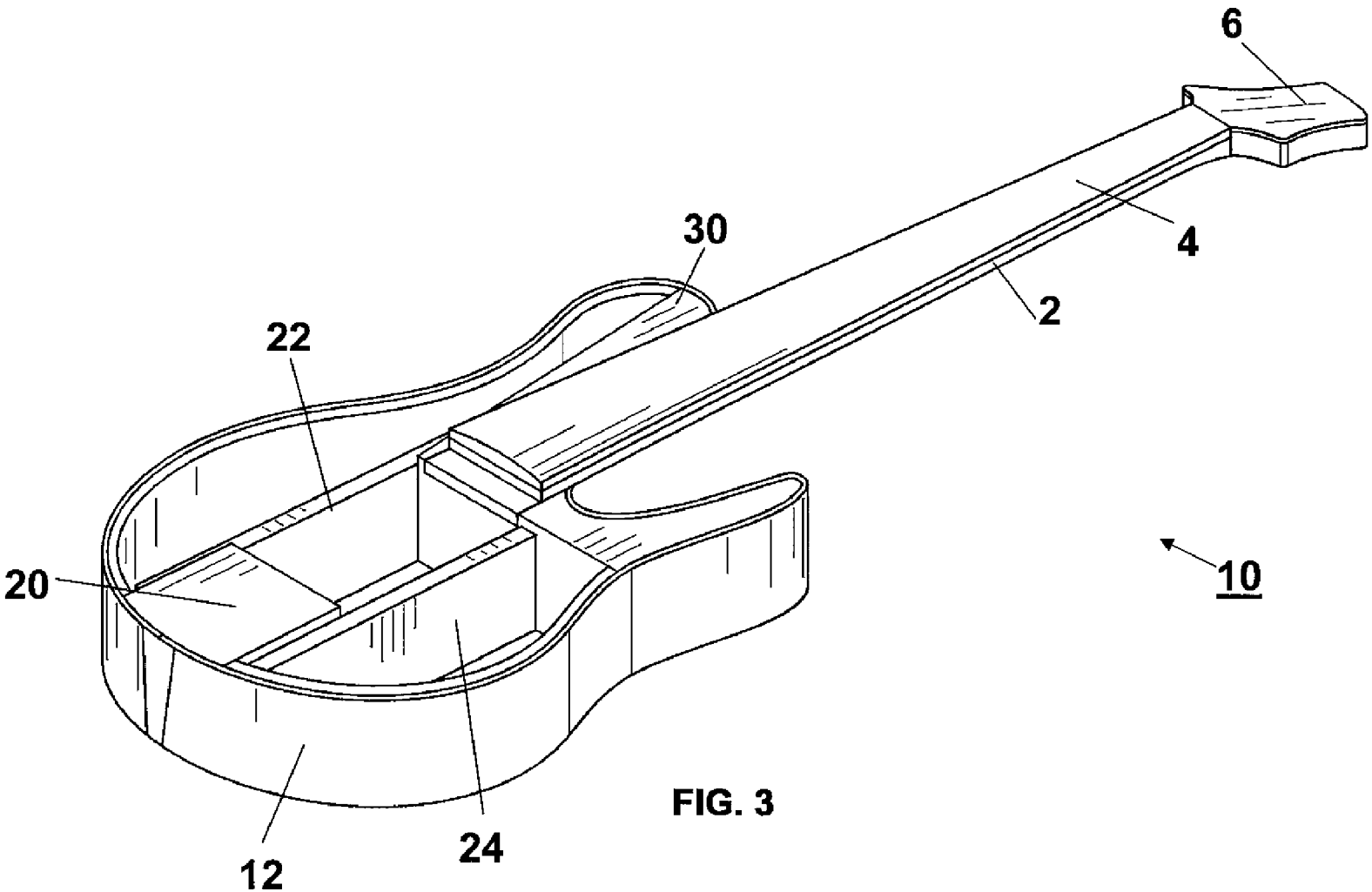
FIG. 3 is a top perspective view showing an exemplary interior portion of an acoustic bass guitar, according to an embodiment of the present invention.
Figure 4:
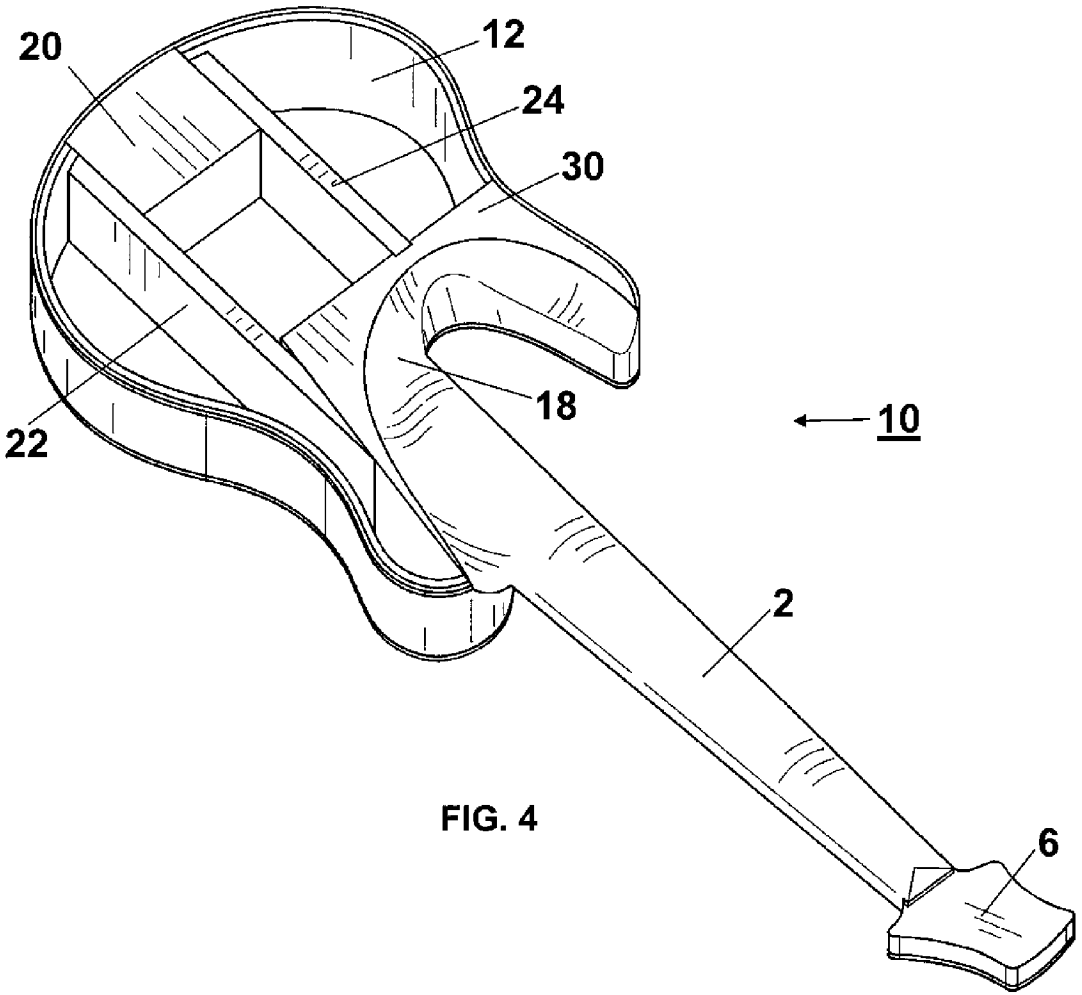
FIG. 4 is a bottom perspective view showing an exemplary interior portion of an acoustic bass guitar, according to an embodiment of the present invention.
Figure 5:
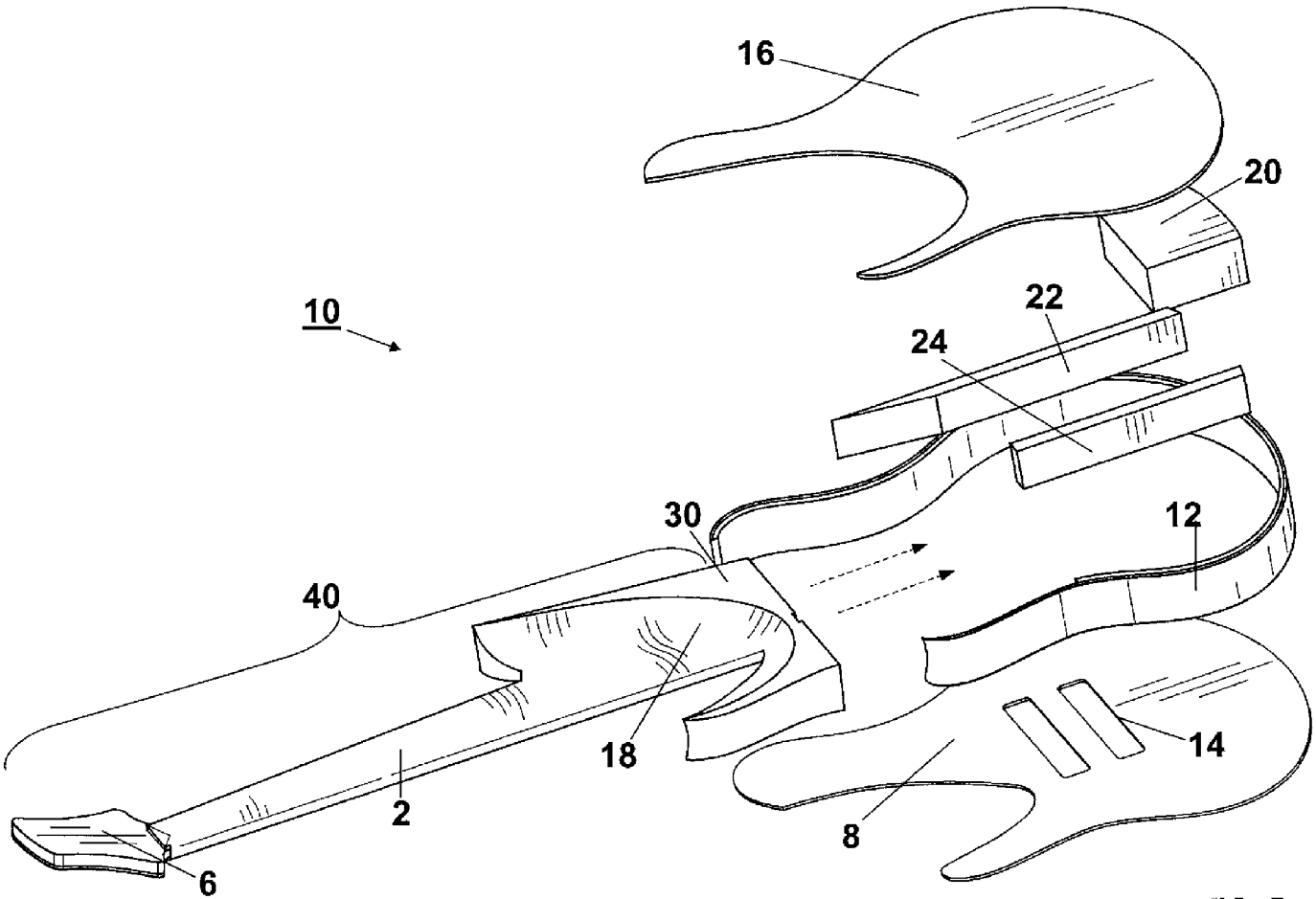
FIG. 5 is an exploded perspective view of an exemplary body of an acoustic bass guitar, according to an embodiment of the present invention.

The present invention relates to a neck-to-body junction for use in acoustic and semi-acoustic stringed instruments, wherein the neck of the instrument is engaged to a solid upper body of the instrument (as shown in FIGS. 3 and 4) to form a junction and wherein the upper body extends into and is connected to a hollow lower body of the instrument. A curved face may then be formed at the junction where the lower part of the neck meets the upper body (as shown in FIGS. 4 and 5) to allow a player's hand to more easily and comfortably reach higher positions on the instrument's neck when the instrument is played in the normal playing position.

Although the description set forth herein describes a bass guitar embodiment of the present invention, one having ordinary skill iii the art will appreciate that the neck-to-body junction disclosed can be applied to a large variety of acoustic and semi-acoustic stringed instruments. Without limiting the foregoing, the neck-to-body junction of the present invention can be applied to many acoustic and semi-acoustic guitars, fretted and fretless acoustic and semi-acoustic bass guitars, all classes of acoustic and semi-acoustic bowed instruments such violins, violas and cellos and other guitar-like stringed instruments such as mandolins, ukuleles and guitarrons.

Figure 1:
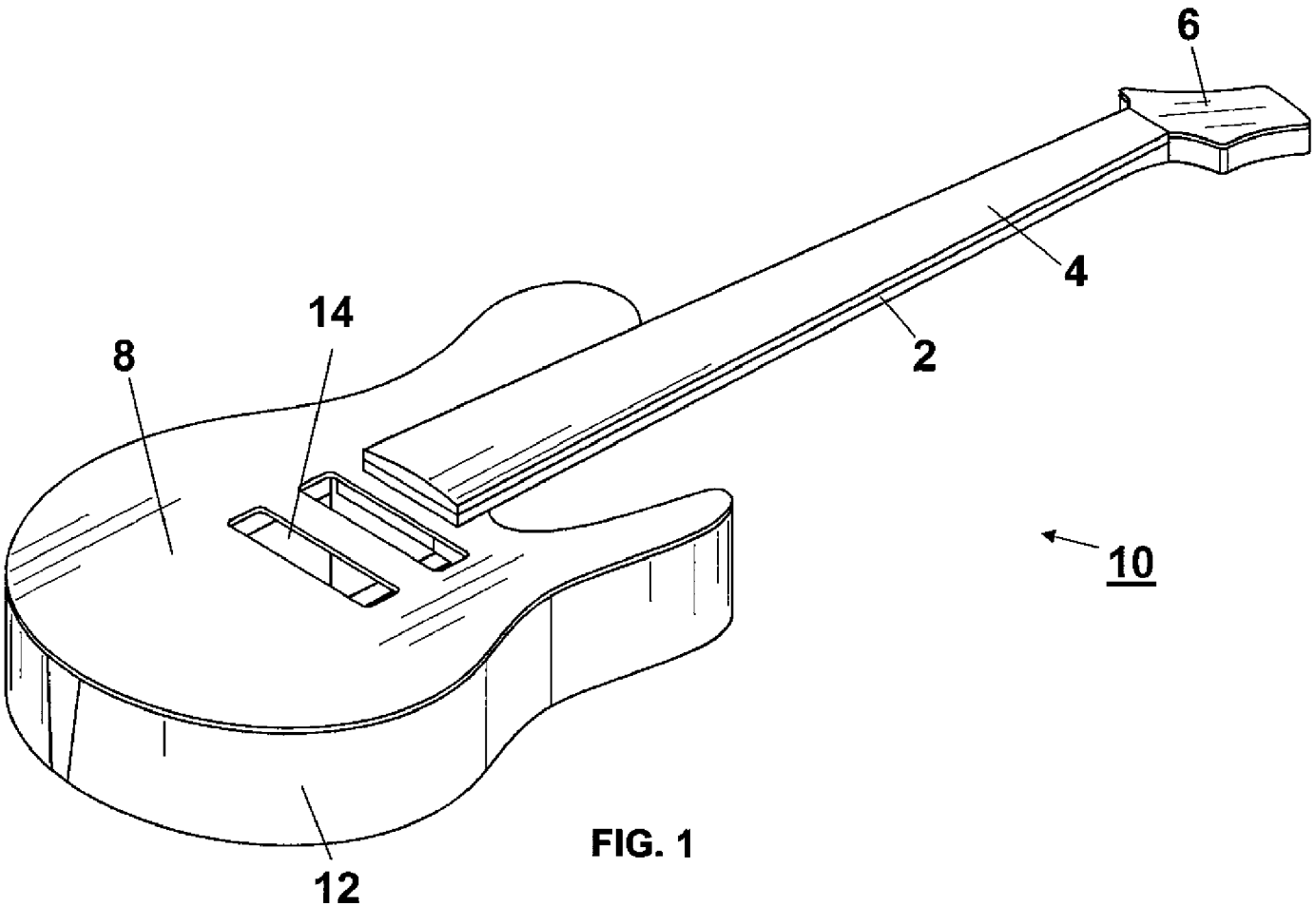
FIG. 1 is a top perspective view showing an exemplary acoustic bass guitar, according to an embodiment of the present invention.

FIG. 1 shows a three-dimensional perspective view of a semi-acoustic bass guitar 10 which comprises a body 12, an upper sound board 8, pickup cutaways 14 in the upper sound board 8, a neck 2, a fingerboard 4 and a headstock 6. According to an embodiment of the invention, the body 12 may have a single-cutaway style, although one having ordinary skill in the art will appreciate that alternative body shapes may be used in conjunction with the present invention. Additionally, one having ordinary skill in the art will appreciate that various parts of the guitar 10 may be composed of any suitable material, including, but not limited to woods, metals, plastics/polymers or any combination thereof. Preferably, the body 12, upper sound board 8 and lower sound board 16 (not shown in FIG. 1) may be composed of woods such as spruce, ebony, rosewood, mahogany, maple, walnut and myrtle which are known for their beauty and resonating capabilities. The body 12, upper sound board 8 and lower sound board 16 are engaged with one another to form the lower body. Any reference to lower body herein shall mean and be a reference to the body 12, upper sound board 8 and lower sound board 16. Any hollow space within the lower body is referred to as the sound box.

According to an embodiment of the invention, the pickup cutaways 14 comprise a configuration typical when using two single coil pickups. However, one having ordinary skill in the art will appreciate that multiple pickup locations, angles, combinations and types may be used depending on the style of instrument and the desired tonal output of the pickups. By way of example and not limitation, pickups may be located near the instrument's bridge, near the base of the neck or anywhere in between. In addition, one or more single coil pickups may be used alone or in combination with one or more Humbucker pickups.

It should be noted that all of the figures herein have omitted certain features inherent to acoustic and semi-acoustic stringed instruments such as, for example, strings, frets, fingerboard inlays, tuning pegs, bridges, pickups, sound holes, knobs, other electrical components, pick guards and saddles. However, one of ordinary skill in the art will recognize if and when these features are necessary to make and use a given embodiment of the present invention.

Figure 2:
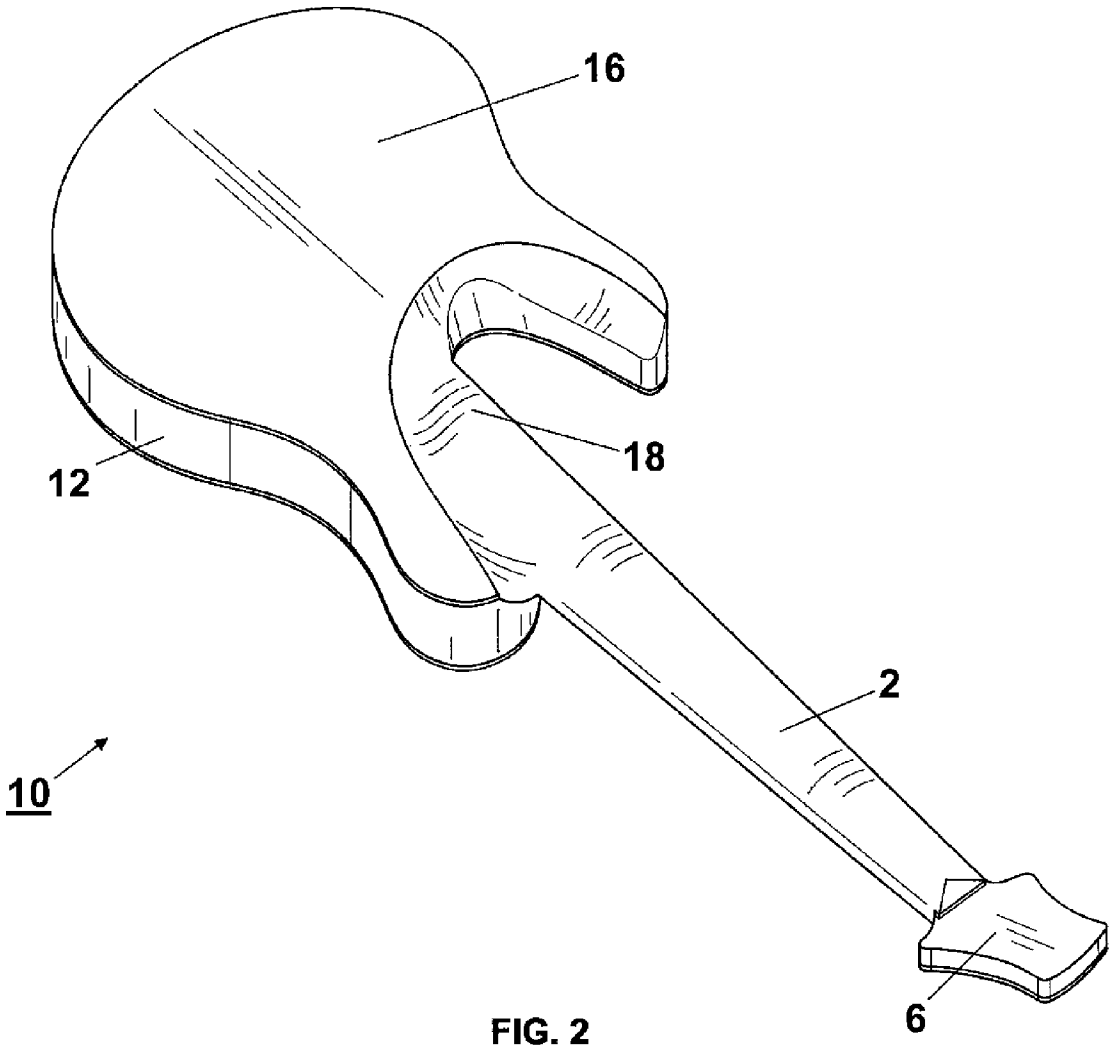
FIG. 2 is a bottom perspective view showing an exemplary acoustic bass guitar, according to an embodiment of the present invention.

FIG. 2 shows a three-dimensional perspective view of the underside of an exemplary semi-acoustic bass guitar 10 comprising a lower sound board 16 and carve-out 18, according to an embodiment of the present invention. The carve-out 18 is situated at the junction between the lower part of the neck 2 and the upper body 30 (shown in FIGS. 3-5). The carve-out 18 provides a user with easier and more comfortable access to higher positions on the neck 2 when the instrument is played in the normal playing position. This additional access to higher positions on the instrument's neck 2 allows the player to easily produce higher notes from the instrument then the instrument is held in the normal playing position. The range of additional access afforded by a given embodiment of the present invention will depend largely on the type of instrument, body style of the instrument and the shape and configuration of the carve-out 18. One having ordinary skill in the art will appreciate that the carve-out 18 can take on a variety of shapes and geometric configurations based on the length of the instrument's fingerboard 4, the shape of the instrument's fingerboard 4 and aesthetic considerations such as overall body size. Preferably, the carve-out 18 extends into the junction in both the perpendicular and radial directions. The amount of perpendicular extension will depend on the thickness of the lower body. Thicker lower bodies will typically require deeper carve-outs.

FIG. 3 shows a three-dimensional perspective view of an exemplary semi-acoustic bass guitar 10 with the upper soundboard 8 removed, according to an embodiment of the present invention. The base of the neck 2 is engaged to an upper body 30 to form a neck member 40 (shown in FIG. 5). According to an embodiment of the present invention, the upper body 30 may be formed of a single solid piece of material, preferably from a light but relatively strong wood such as maple or walnut. The base of the neck 2 is then engaged to the upper body 30. The term "engage" or "engaged" as used herein is intended to include but is not limited to any suitable means or method to connect, integrally connect, attach, join, affix, adhere, etc. Preferably, the neck 2 and upper body 30 are engaged using a commercially available adhesive suitable for stringed instruments. Although the upper body 30 is shown as in FIGS. 3-5 as a single piece, one having ordinary skill in the art will appreciate that the upper body 30 may be constructed from multiple pieces of suitable material. In addition, the upper body 30 may be constructed of laminated pieces of wood. In addition, one having ordinary skill in the art will recognize that alternative shapes and sizes may be used in designing the upper body 30. By way of example and not limitation, the upper body 30 may have a double cut-away, a single cutaway or a dreadnought shape.

In addition to providing shape and support to the upper portion of the lower body of an acoustic or semi-acoustic stringed instrument, the shape and size of the upper body 30 may be chosen based on its impact on the size of the hollow cavity that forms part of the instrument's sound box. For example, a smaller upper body 30 may be selected to maximize the size of the hollow cavity of the instrument's sound box. Additionally, various holes may be cross-drilled through parts of the upper body 30. The number and size of the holes may be selected so as to reduce the weight of the instrument and to promote greater resonance within the upper body thereby contributing to greater overall volume of the instrument. Preferably, the holes will have a diameter of at least ⅜ of an inch and will be drilled through the entire thickness of the upper body 30. The holes should be placed so as to maintain the overall strength and rigidity of the upper body 30. In addition, one or more sound holes may be drilled through the upper body 30 and into the sound box at various locations, preferably near the carve-out 18, to promote greater volume output by the sound box. The size and placement of the holes should take into account the overall size of the upper body 30 and should be placed so as not to compromise the strength and rigidity of the upper body 30. One having ordinary skill in the art will appreciate that such additional sound holes may be used to adjust the tonal characteristics and overall volume of the instrument while not detracting from the overall aesthetic appearance.

According to an embodiment of the invention, the upper body 30 is engaged to the lower body such that the upper body 30 extends into the hollow cavity of the lower body as is shown in FIGS. 3 and 5. Preferably, the upper body 30 is engaged to the lower body using an appropriate commercially available adhesive that can provide sufficient adhesion strength. However, alternative methods such as screws and pins may be used to affix the upper body 30 to the lower body. According to an embodiment of the present invention, a bridge support 20 may be affixed to the end of the lower body that is opposite the neck 2. The bridge support 20 provides additional strength and rigidity at the position where the bridge will be mounted to the upper soundboard 8. One having ordinary skill in the art will appreciate that the size and shape of the bridge support 20 can vary depending on the type of instrument being constructed, the overall string tension and other factors such as the desired hollow space in the sound box for purposes of maximizing the sound box's ability to resonate sound. Other embodiments of the invention, including for example acoustic instruments, may not incorporate a bridge support.

According to an embodiment of the present invention, supports 22, 24 may be used with or without a bridge support 20 to provide additional strength and rigidity to the lower body of the instrument. One having ordinary skill in the art will appreciate that the size, shape, material of construction and placement of supports 22, 24 can very depending on the type of instrument being constructed, the overall string tension and other factors such as the desired hollow space in the sound box for purposes of maximizing the sound box's ability to resonate sound. In addition, other embodiments of the invention may include more than two supports or may include no supports at all.

According to an embodiment of the present invention, supports 22, 24 can serve as mounting braces for electronic pickups mounted in the pickup cutaways 14. Instead of mounting to the upper sound board 8, the pickups can be mounted to the support braces 22, 24 in a floating arrangement relative to the upper sound board 8. This floating arrangement minimizes any physical contact between the pickups and the sound board 8 thereby maximizing the sound produced by the sound board 8.

It is to be understood that the exemplary embodiments are merely illustrative of the invention that many variations of the above-described embodiments can be devised by one skilled in the art without departing from the scope of the invention. It is therefore intended that all such variations be included within the scope of the following claims and their equivalents.

What is claimed is:

1. A stringed instrument comprising:

a lower body comprising a sound box having an open end and a closed end;

a neck having a first end and a second end;

a solid upper body engaged to:

the second end of the neck to form a junction, and the lower body such that the solid upper body extends at least partially into the first open end of the sound box;

a carve-out from the junction; and a fingerboard engaged to a top side of the neck wherein the carve-out affords access to a position above a twelfth fret of the fingerboard when the instrument is played in a normal playing position.

2. The stringed instrument according to claim 1, wherein the carve-out extends in a perpendicular and a radial direction.

3. The stringed instrument according to claim 1, further comprising at least one support housed within the sound box.

4. A stringed instrument comprising:

a lower body comprising a body piece engaged to:

an upper sound board having at least one rectangular cutaway for accepting an electronic pickup, and a lower sound board to form a sound box having an open end and a closed end;

at least one support housed within the sound box;

a neck comprising a head stock with at least one tuning peg and an end opposite the head stock;

a solid upper body having a single cut-away shape, wherein the solid upper body is engaged to:

the end of the neck opposite the headstock to form a junction, and the lower body such that the solid upper body extends into the open end of the sound box;

a carve-out from the junction; and a fingerboard engaged to a top side of the neck, wherein the carve-out affords access to a position above a twelfth fret of the fingerboard when the stringed instrument is played in a normal playing position.

* * * * *